US010696458B2

(12) United States Patent
Eisen

(10) Patent No.: US 10,696,458 B2
(45) Date of Patent: Jun. 30, 2020

(54) HOLDING DEVICE AND LID DEVICE FOR A RECEPTACLE, RECEPTACLE SYSTEM AND METHOD FOR ASSEMBLING THE RECEPTACLE SYSTEM

(71) Applicant: VitaJuwel Gmbh, Scheidegg (DE)

(72) Inventor: Ewald Eisen, Scheidegg (DE)

(73) Assignee: VitaJuwel GmbH, Scheidegg (DE)

( * ) Notice: Subject to any disclaimer, the term of this patent is extended or adjusted under 35 U.S.C. 154(b) by 201 days.

(21) Appl. No.: 15/788,994

(22) Filed: Oct. 20, 2017

(65) Prior Publication Data

US 2018/0111728 A1 Apr. 26, 2018

(30) Foreign Application Priority Data

Oct. 20, 2016 (DE) ..... 10 2016 120 053

(51) Int. Cl.
*B65D 51/00* (2006.01)
*B65D 51/32* (2006.01)
(Continued)

(52) U.S. Cl.
CPC ..... *B65D 51/32* (2013.01); *A47G 19/12* (2013.01); *B65D 39/08* (2013.01); *B65D 47/06* (2013.01);
(Continued)

(58) Field of Classification Search
CPC ..... A47G 19/12; A47G 2200/14; A47G 2200/16; A47G 2200/205; B65D 39/08; B65D 47/06; B67B 3/20
See application file for complete search history.

(56) References Cited

U.S. PATENT DOCUMENTS 3,475,597 A * 10/1969 Desloge ..... H05B 3/00 219/535
7,192,211 B2 3/2007 Heidenreiter

FOREIGN PATENT DOCUMENTS

DE 202004017614 U1 4/2006
DE 102011122896 A1 3/2013

* cited by examiner

*Primary Examiner* — Anshu Bhatia
(74) *Attorney, Agent, or Firm* — Bachman and Lapointe PC; George Coury

(57) ABSTRACT

The present invention relates to a receptacle system and component parts thereof, for example a carafe with a lid, wherein an elongated object, for example a (stirring) rod can remain in the opening of the receptacle when the lid is in place. The previously known receptacle systems are susceptible to damage. It is therefore an object of the present invention to provide advantageous components of a receptacle system and an advantageous receptacle system per se, wherein the susceptibility to damage is reduced. This object is achieved by a holding device, a lid device and a receptacle system as disclosed herein. According to an embodiment, the holding device essentially has a hollow cylindrical device body, which in turn is composed inter alia of two cylinder portions which are connected to one another by means of a folding device. Both cylinder portions are connected to one another by means of the folding device, such that they can pivot about a pivot axis. To this end, the device body of the holding device forms, by means of the hollow volume thereof, an essentially central rod receptacle with a holder inner surface extending in the axial direction of the device body. Due to the unfoldable structure of the holding device, it is possible for the rod receptacle to encompass a shaft of a rod.

17 Claims, 4 Drawing Sheets

Figure 1:
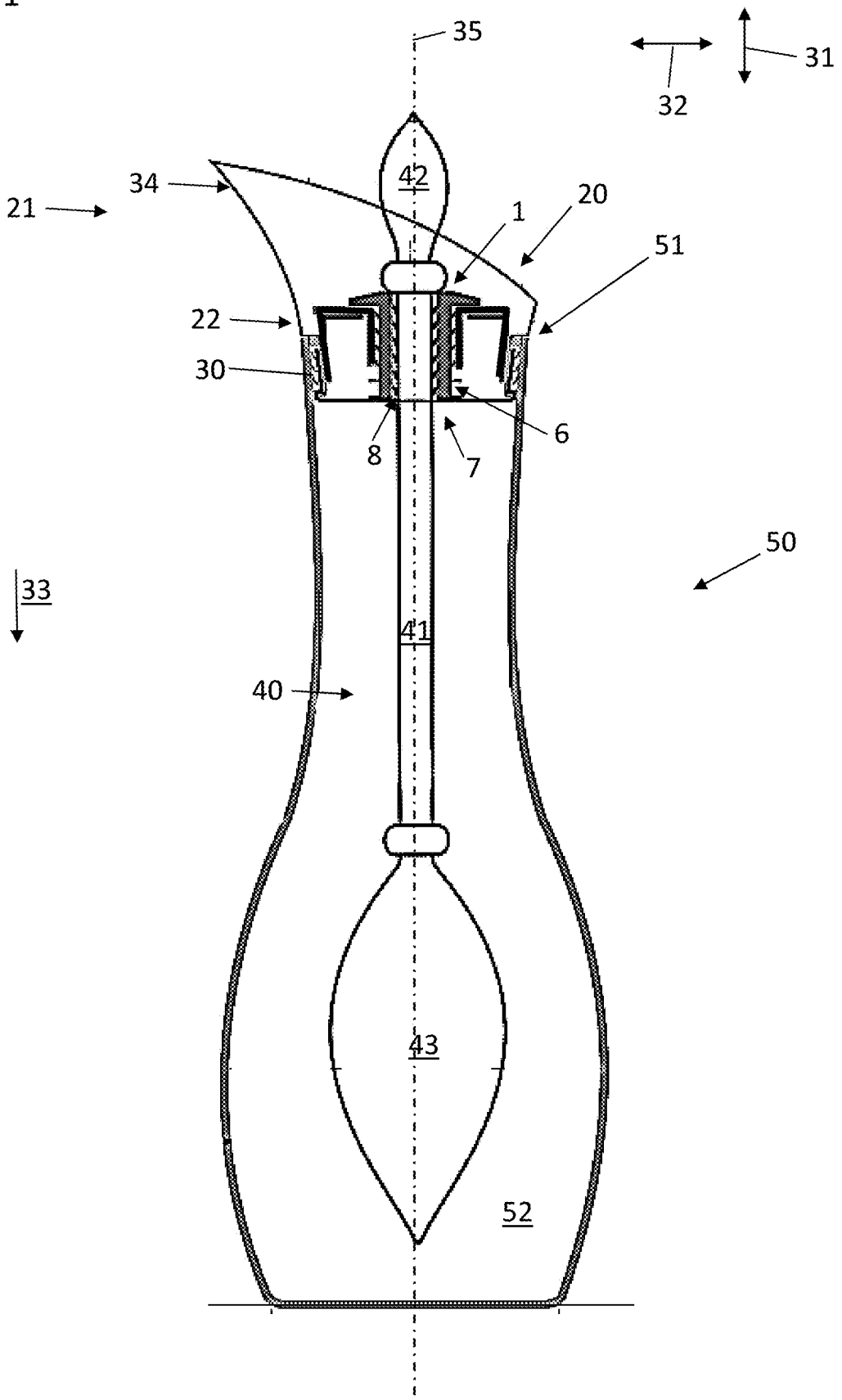

(51) Int. Cl.

| | |
|---|---|
| ***A47G 19/12*** | (2006.01) |
| ***B65D 39/08*** | (2006.01) |
| ***B65D 47/06*** | (2006.01) |
| ***B67B 3/20*** | (2006.01) |

(52) U.S. Cl.
CPC ..... *B67B 3/20* (2013.01); *A47G 2200/14* (2013.01); *A47G 2200/16* (2013.01); *A47G 2200/205* (2013.01)

HOLDING DEVICE AND LID DEVICE FOR A RECEPTACLE, RECEPTACLE SYSTEM AND METHOD FOR ASSEMBLING THE RECEPTACLE SYSTEM

TECHNICAL FIELD

The present invention relates to a receptacle system and component parts thereof, for example a carafe with a lid, wherein an elongated object, for example a (stirring) rod can remain in the opening of the receptacle when the lid is in place. Receptacles of this type can accommodate beverages for example.

PRIOR ART

Receptacles for accommodating beverages are well known, for example the ancient Romans stored wine in amphorae provided therefor, which were closed with a lid. In order to keep the distribution of suspended solids constant in this wine over the volume, it would have been possible, by means of rods, to stir the wine at regular intervals, wherein the lid could have had a corresponding opening therefor.

Globally, carafes are used in order to present beverages, for example water or wine, in a visually attractive manner or to allow the wine to "breathe". In order to prevent suspended particles located in the air, for example dust, from contaminating the liquid stored in the carafe, a lid is often provided for closing the carafe.

At the same time, it is common in the case of wine carafes for example to permanently keep an elongated, rod-like wine thermometer in the liquid of the carafe, wherein a part of the elongated thermometer protrudes beyond the edge at the lid of the carafe.

Disadvantages of the Prior Art

The previously known receptacle systems are susceptible to damage, which may be caused by impact contact between the components lid, receptacle and rod-like object. Furthermore, the arrangement of the individual components according to the prior art may lead to undesired noise generation.

Related Problem

It is therefore an object of the present invention to provide advantageous components of a receptacle system and an advantageous receptacle system per se, wherein the susceptibility to damage is reduced, and a user experiences a pleasant acoustic and haptic product experience without disruptive vibrations, impacts and noises.

Solution

The above object is achieved by means of a holding device, a lid device and a receptacle system all as disclosed herein, and wherein a method disclosed herein relates to an advantageous assembly of the receptacle system.

According to an embodiment, the holding device essentially has a hollow cylindrical device body, which in turn is composed inter alia of two cylinder portions which are connected to one another by means of a folding device. Both cylinder portions are connected to one another by means of the folding device, such that they can pivot about a pivot axis. The pivot axis runs parallel to a longitudinal axis or axial direction of the device body and is arranged off centre with respect to the longitudinal axis. Both cylinder portions are therefore fastened to one another in a foldable manner at the edge region thereof, so that these cylinder portions are arranged next to one another in the radial direction in the unfolded state and are arranged with the flat sides thereof facing one another in the folded state. In one non-limiting embodiment the cylinder portions are cylinder halves.

The holding device is used such that it can be arranged in a lid of a receptacle and at the same time is able to carry a rod protruding into the receptacle.

To this end, the device body of the holding device forms, by means of the hollow volume thereof, an essentially central rod receptacle with a holder inner surface extending in the axial direction of the device body.

Owing to the foldable structure of the holding device, it is possible that the rod receptacle can encompass a shaft of a rod, even if the two ends or other sections of the rod have a diameter which is larger than the internal diameter of the rod receptacle. To this end, the holding device is placed around the shaft of the rod in the unfolded state and folded together.

According to an embodiment of the invention, the rod and holding device are constructed in such a manner with regards to the geometric shape thereof, that an external diameter of the shaft of the rod corresponds to an internal diameter of the rod receptacle. In particular, internal diameter and external diameter are chosen in such a manner that—in the case of a folded device body of the holding device—the rod is mounted securely in the rod receptacle.

According to a further embodiment of the invention, the rod receptacle of the holding device is produced from a flexible elastomer, so that the shaft is present in the rod receptacle under pre-stress, is essentially fixed in the radial direction and cannot be displaced in the axial direction. In particular, the shaft of the rod can be produced from a hard, brittle material, for example glass. In this case, the internal diameter, the shape and the elasticity of the rod receptacle and the external diameter of the shaft are adapted to one another in such a manner that manufacturing tolerances of these components are compensated by the elasticity of the rod receptacle. In this case, accumulated manufacturing tolerances may be approximately up to 1 mm.

Furthermore, the rod receptacle may be equipped with internal sealing means, which are configured in such a manner that the rod is essentially securely accommodated by the folded holding device substantially in the radial direction and in the axial direction.

According to an embodiment, these internal sealing means are configured as at least one sealing lip arranged in a circular manner on the holder inner surface. This protrudes from the internal sealing surface at least in the radial direction; in particular, the internal sealing lip is arranged obliquely to the holder inner surface.

According to an embodiment, internal sealing means, the internal diameter of the rod receptacle, and the external diameter of the shaft are realized in such a manner geometrically with respect to one another that the rod is securely accommodated by the holding device and at the same time a substantially fluid-tight connection is produced.

According to a further embodiment, the holding device is constructed such that it can be accommodated by a holder receptacle of a lid device of a receptacle. To this end, the holder receptacle of the lid device and the holder external surface of the holding device would be adapted to one another geometrically so that a substantially fixed connection between holding device and lid device can be produced.

In particular, the holding device has external sealing means on the holder external surface thereof, wherein these external sealing means can be constructed as at least one external sealing lip according to an embodiment. Viewed in longitudinal section of the holding device, an external sealing lip of this type protrudes beyond the holder external surface in the radial direction and in particular stands out perpendicularly from the holder external surface.

With respect to the longitudinal section of the holding device, the external sealing lip, viewed in the cross section thereof, can for example have a length of 3 mm to 5 mm, particularly 3 mm.

In a development of the invention, it is disclosed that the holding device has interlocking means, which are arranged in such a manner on both cylinder portions, that in each case one interlocking element is provided on/in each cylinder half. The interlocking elements correspond to one another in this case in terms of arrangement and in terms of geometric form, so that—the same in the folded state of the holding device—together form a positive fit acting at least in the axial direction, and the cylinder portions are fixed in the axial direction such that they are interleaved with one another in a positive-fitting manner.

In particular, the interlocking means are arranged on an opposite side of the folding device with respect to the circumference of the cylinder portions. Consequently, the interlocking means and the folding device make it possible for the cylinder portions to be connected in a structurally fixed manner: This takes place on one circumferential side by fixing in the axial direction with the aid of the folding device, and on the opposite circumferential side by means of the positive-fitting interlocking means acting in the axial direction. Advantageously, the interlocking means and the folding device are provided in a radial outer region of the device body of the holding device.

According to an embodiment, a first interlocking element is constructed as, for example a conical projection protruding from the cylinder half surface of a first cylinder half. Accordingly, the second interlocking element is configured as a recess, corresponding in a positive-fitting manner with the first interlocking element, in the cylinder half surface of a second cylinder half, for example a conical depression. If the holding device is folded together, then the projection of the first interlocking element lies in the recess of the second interlocking element. The positive-fitting connection is produced as a result.

According to a further detailed form, at least one cylinder half is equipped with spacing means, so that, in the case of an appropriate form of the folding device, both cylinder portions in the folded state are always spaced with a spacing of 0.5 mm to 2.5 mm, particularly 1 mm to 2 mm and in particular of exactly 2 mm, from one another. In particular, the spacing means can be provided integrated with the interlocking means, so that the minimum spacing between both cylinder portions is provided by the geometric construction of the interlocking elements.

In the course of the invention, a lid device for the receptacle is furthermore disclosed, wherein the lid device has the holding device according to one or more of the above-described embodiments and a holder receptacle for the holding device. This lid device, the holding device provided therein and the rod accommodated in turn thereby form a substantially complete cover of a receptacle opening of the receptacle.

According to an embodiment, the lid device can be structured into a spout section and a closure section, wherein the spout section adjoins the closure section on the side facing away from the receptacle in the axial direction. In particular, the spout section has a funnel-like shape, the diameter of which widens. The spout section shows structural means, which promote pouring, over the circumference on one side, for the targeted pouring of a liquid located in the receptacle. These structural means are for example configured as a radial and axial material enlargement and/or channel.

The closure section has the task of being able to be accommodated securely yet detachably by the receptacle opening and to carry the holding device in the holder receptacle. To this end, the holder receptacle is equipped with a cylindrical lid internal surface, which extends in the axial direction and passes through the lid device, for accommodating the holding device. The geometric shape or the diameter of the lid internal surface and the geometric shape or the diameter of the external sealing means and/or the holder external surface of the holding device are adapted to one another in such a manner that a secure yet detachable and essentially fluid-tight can be produced between the holding device and the holder receptacle.

The term "fixed connection" used in the course of this description, is to be interpreted such that when the holding device is accommodated in the holder receptacle, normal forces are created between the holder receptacle and the holding device, which normal forces prevent an excessive movement of the rod, caused by accelerations acting thereon, with respect to a receptacle body—assuming a secure connection between the lid device and receptacle. Thus, if the receptacle is moved by a user with mounted lid device and rod—for example for pouring—then the connections between rod and holding device, between holding device and holder receptacle and also between lid device and lid opening are configured securely in such a manner that the part of the rod located in the receptacle cannot collide with the receptacle body. This reduces the risk of damage and injuries and effectively prevents undesired noise generation.

In this context, it is to be added that the rod has a length of 20 cm to 50 cm, particularly of 25 cm to 40 cm, and in particular of 30 cm to 35 cm. Furthermore, it is conceivable that the rod is provided with a thickened rod body at one end, wherein heavy elements, such as for example stones and/or precious stones, are arranged in the rod body. For example, the rod body can have a diameter of 2 cm to 7 cm, particularly of 3 cm to 6 cm and in particular of 4 cm to 5 cm. Because the thickened rod body can be arranged with a spacing, for example of 10 to 25 cm in the axial direction, from the holding device, a moment acting on the holding device and forces resulting therefrom are brought about by a movement of the receptacle in the radial direction. The secure connection makes it possible for these resulting forces to be conducted away from the holding device into the receptacle body, without the rod, particularly the rod body thereof, executing large translational movements in the radial direction in an undesired manner.

According to an optimum design, the rod can be constructed in accordance with one or more embodiments described in the patent application DE 10 2011 122 896 A1 of the applicant, which is incorporated here.

According to a embodiment of the lid device, the holder receptacle is essentially provided in the centre of the lid device. This leads to equal spacing of the rod inside a receptacle, which is rotationally symmetrical in this case.

The lid device can be subdivided into an annular region and a lid region. Accordingly, the connection would be produced between the lid device and the receptacle in the annular region, whereas the lid region takes on the actual task of covering the receptacle opening. Accordingly, the holder receptacle can be provided in the lid region.

According to an embodiment, the holder receptacle or the lid region is equipped with a shoulder, which forms a stop for the holding device acting in the axial direction. Correspondingly, according to an embodiment of the holding device, a shoulder surface is provided protruding in the radial direction on the device body, which shoulder surface, together with the shoulder of the holder receptacle, effects at least one fixing of the holding device in the holder receptacle acting on one side in the axial direction. If, for example, the holding device with rod is introduced from above into the holder receptacle, then this translational movement in the axial direction is possible until the shoulder surface of the holding device impacts against the shoulder of the holder receptacle.

According to an embodiment of the lid device, a spout opening for liquid is provided in the closure section, wherein this spout opening can be arranged in the annular region and/or in the lid region. It is relevant that the spout opening produces a fluid connection, which can be used for pouring, between the volume of the receptacle and the pouring section, so that liquid located in the receptacle can be poured out via the spout opening when the lid with holding device and rod is mounted. Thus, the spout opening constitutes a second or parallel opening in the lid device for the holder receptacle.

For example, the lid device or non-sealing components of the lid device can be produced from metal, particularly from a non-rusting metal, such as for example stainless steel or aluminium.

The spout opening can, according to an embodiment, also be constructed in a suitable manner integrated with the holder receptacle, wherein the holder receptacle must have special opening regions for this purpose, through which a liquid can flow out of the interior of the receptacle. Thus, the holder receptacle would have a first region, which is used explicitly for carrying the holding device. Furthermore, a second region would be present, which is created with the clear intention of being used regularly as a spout opening. According to a design, this would mean that in addition to the integrated spout opening, there is no further spout opening present in or on the lid device.

A chance or small leakage of the liquid at a sealing point, for example between rod and holding device, cannot be considered as a spout opening in the sense of the invention.

The suitability of the spout opening for pouring can for example be defined in such a manner that when the filled receptacle (e.g. filled with 1 litre) is tilted by 90° or to the horizontal, at least a certain flow rate, for example at least 2 l/min, preferably at least 2.5 l/min, is achieved.

According to an embodiment, the spout opening in the lid device is provided in such a manner that through the same, both liquid can be poured out of the receptacle and the receptacle can be filled with liquid. The lid device and the receptacle opening of the receptacle are consequently designed in such a manner that the lid device does not have to be removed from the receptacle opening for normal use, in order to fill the receptacle with liquid.

According to a corresponding design, the lid device is suitable for outputting and also accommodating a liquid in accordance with the above-mentioned flow rates, wherein at the same time, owing to the special design of the lid device, the inner volume of the receptacle is protected from contamination with suspended particles from the environment.

This is achieved in particular in that the spout opening or the filling opening essentially does not have any partial opening cross section running directly in the horizontal direction. In this way, it is possible to prevent dust from being able to settle in the receptacle through the spout opening due to gravity. It is clear to the person skilled in the art in this case, that a permanently existing spout opening always allows a small number of suspended particles located in the ambient air to pass through into the receptacle and also out of the receptacle. By contrast, the aim of the design according to the configuration of the lid device, is to prevent an excessive contamination due to the settling in the vertical direction of dust through the spout opening into the interior of the receptacle.

In particular, the spout opening can be formed by the lid device in such a manner that a part of the lid device overlaps the spout opening from above in the radial direction.

Furthermore, the spout opening can be constructed in such a manner that there is no line of sight passage running in the axial direction between the receptacle interior and the surroundings. A falling dust particle therefore cannot find a way into the interior of the receptacle in the case of movement in the vertical direction or in the axial direction—that is to say in the vertical case.

According to an embodiment, the lid sealing means can be provided externally on the annular region in the radial direction. It is conceivable that the lid device has a circumferential groove-like depression in the annular region, in which depression the lid sealing means can be provided similarly to a circumferential sealing ring.

With the aid of the annular region and the lid sealing means provided therein, a fixed, yet detachable connection can be provided between the lid device and the receptacle.

Using the expression "fixed yet detachable" should ensure the interpretation according to the invention of the arrangement of the holding device in the holder receptacle and the lid device in the receptacle opening: such connections are suitable for not being detached by shaking caused by normal use. However, if the user wishes to open these connections, then the user is in a position by means of physical force to detach the fixed position of the connection, e.g. by overcoming frictional forces.

Furthermore, the spout section can be connected to the annular region of the lid device, particularly constructed in one piece. For example, the spout section and the annular region of the closure section can be produced in one piece by deep drawing a metal sheet.

According to a further embodiment of the invention, the lid region of the closure section is realized as a separate component with respect to the annular region and e.g. connected to the same in a positive-fitting or materially-bonded manner.

In particular, a connecting region can be provided between lid region and annular region, as a result of which the lid region is positioned and fixed in an axially displaced manner with respect to the annular region. In particular, the connecting region can be constructed in a not completely circumferential manner, so that sections between lid region and annular region without connecting region form the spout opening for pouring out the fluid located in the receptacle.

Furthermore, in the context of the invention, a receptacle system is disclosed, which is at least composed of a receptacle with a carafe-like receptacle body and a cylindrical receptacle opening, a lid device with holding device and rod with a cylindrical shaft provided therein. The rod is carried by the holding device, which is in turn provided in the holder receptacle of the lid device, wherein the lid device is securely arranged in the receptacle opening.

According to an embodiment, the receptacle body is produced from glass.

Thus, first a receptacle system is provided, wherein a liquid can be stored in the receptacle body in a visually appealing form. The liquid can in this case be poured out through the lid device in a simple manner, without the lid device having to be removed. At the same time, the lid device carries the rod by means of the holding device. In this case, the rod is constructed in such a manner in the holding device, the holding device in the holder receptacle, and lid device in the receptacle opening and securely connected yet detachably mounted, so that the rod only executes movements in a negligible manner when the receptacle system is moved by a user, but cannot collide with a wall of the receptacle body in any case—in the case of conventional use.

The thus formed receptacle system is suitable to be both emptied and filled through the spout opening of the lid device—which is therefore also considered to be a filling opening—without the lid device having to be removed from the receptacle for this purpose. The lid device, particularly the lid region and the annular region of the lid device, is configured in such a manner that flying particles cannot penetrate into the interior of the receptacle or can only penetrate to an insignificant extent.

The above-described connections are equipped according to an embodiment in such a manner so that an essentially fluid-tight connection is provided between these components.

The formulation "essentially sealed or fluid-tight" which has already been used several times previously, should clarify that this is not a completely sealed connection here, but rather that a few drops, or possibly a trickle, may very well make it through these connections, particularly if these connections were to be loaded by a fluid which is pressurized. The sealing effect, however, makes it possible that a sloshing liquid present in the receptacle cannot escape from these connections, for example spray out therefrom. For example, liquid should also be prevented from being able to flow out between the rod and holding device or at the holding device in such a manner, so that during pouring, liquid could reach the rod and run along the same.

In a development of the invention, a method for assembling this receptacle system is disclosed, which has the following steps:

After the lid device has been provided without mounted holding device, the lid device can be slipped over a rod end of the rod, wherein the rod thus passes through the holder receptacle of the lid device. Up to now, there is no fixed connection between the lid device and rod, but rather it is necessary to manually position the two components with respect to one another.

According to an embodiment, the rod is composed, inter alia, of a small rod end and a large rod body—as also shown for example in the patent application DE 10 2011 122 896 A1—which are connected to one another by means of the shaft. In particular, the internal diameter of the holder receptacle is larger than a maximum external diameter of the small rod end and smaller than a largest external diameter of the large rod body. Accordingly, the lid device can only be slid over the small rod end.

In a next step, the holding device is placed onto a region of the shaft, which lies between the small rod end and the lid device arranged in the preceding step. If the holding device is arranged on the shaft by folding up the cylinder portions, then it can if appropriate be pushed onto the small rod end until directly adjacent to the upper end of the shaft.

In the course of a following step, the lid device is to be displaced with respect to the mounted holding device or the holding device is to be displaced with respect to the lid device, until the holding device is securely accommodated by the holder receptacle, and in particular the shoulder surface of the holding device rests on the shoulder of the lid device. By means of these steps, a unit has been created, which, inter alia, is composed of the lid device with mounted holding device and mounted rod.

This unit is ultimately to be introduced and fixed into the receptacle opening of the receptacle, wherein the receptacle can be filled prior to this step through the receptacle opening or after this step through the spout opening.

The previously described embodiments can be combined with one another in any desired, yet sensible manner.

SHORT DESCRIPTION OF THE FIGURES

The attached drawings show embodiments and are used, together with the description, for explaining the principles of the invention. The elements of the drawings are relative to one another and not necessarily true to scale.

Identical reference numbers correspondingly designate similar parts.

Figure 2:
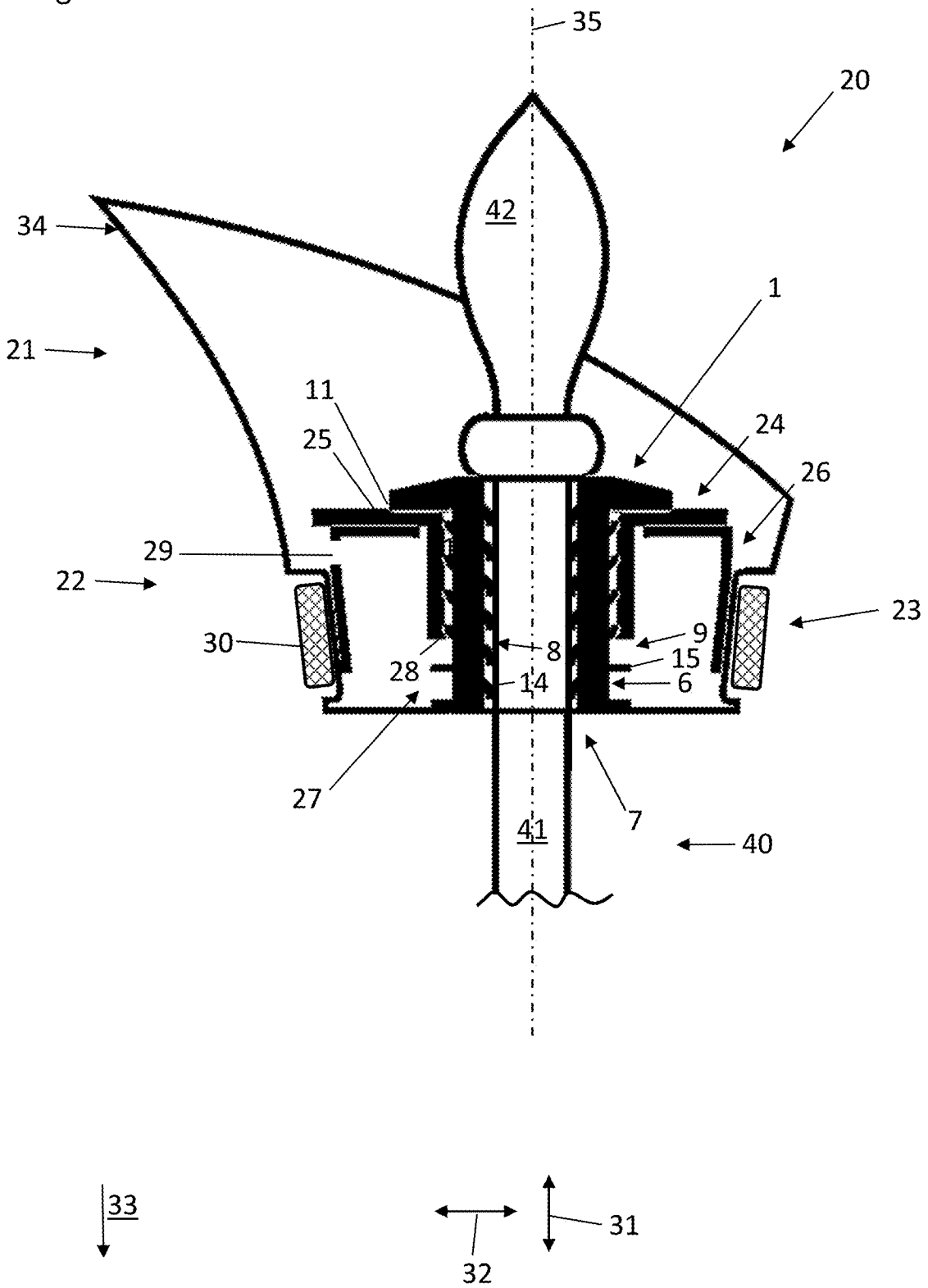
Figure 3A:
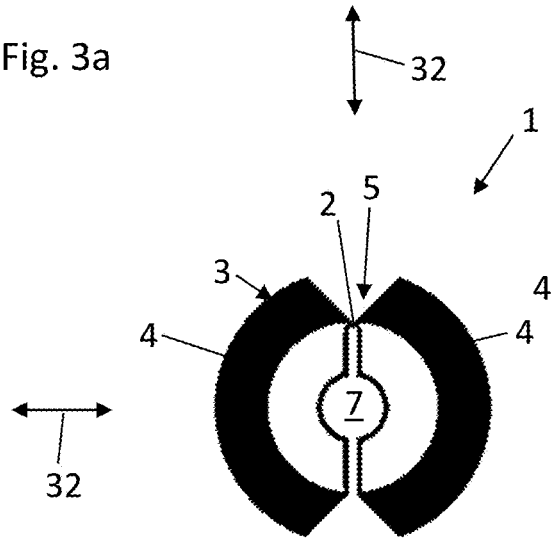
Figure 4:
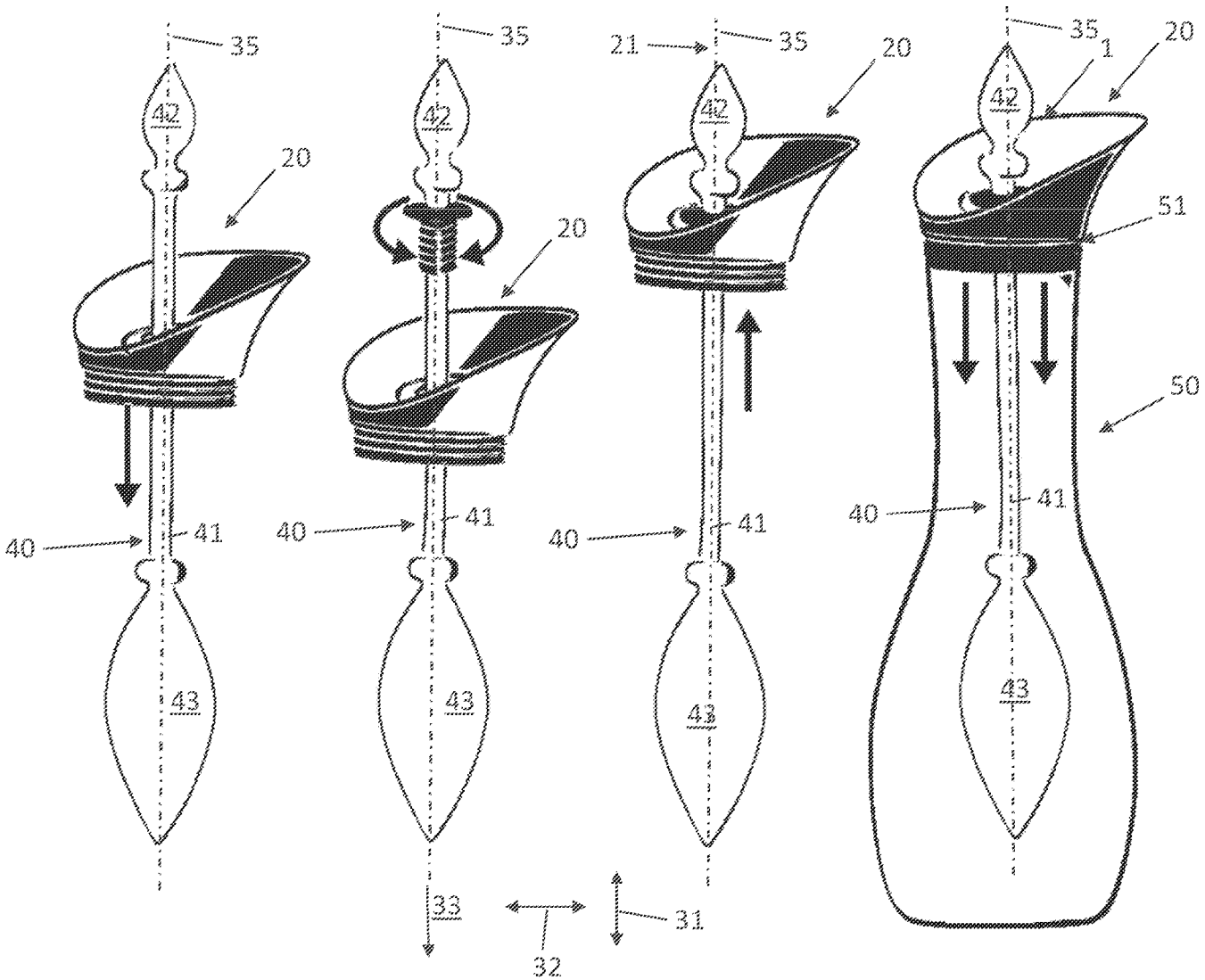

FIG. 1 shows an embodiment of a receptacle system,

FIG. 2 presents a detailed detail view of the lid device of the receptacle system according to FIG. 1 and the rod mounted therein, FIGS. 3*a*) to *d*) describe the holding device of the lid device of the receptacle system according to FIG. 1 in various views, and FIG. 4 explains a method for assembling the receptacle system according to FIG. 1.

EXEMPLARY EMBODIMENTS

To clarify the overall context, a first embodiment of a receptacle system 100 is presented in FIG. 1. This comprises a carafe-like receptacle 50 with a receptacle opening 51 and a receptacle body 52. The receptacle opening 51 has a substantially cylindrical edge section, in which a lid device 20 is inserted.

In FIG. 1 to FIG. 4, an axial direction 31, a radial direction 32 and details such as "top" or "bottom" 33 are provided. These details should be used for orientation in the context of this description, wherein the axial direction 31 is essentially orientated on a longitudinal axis 35 of the receptacle 50, the lid device 20, the holding device 1 and/or the rod 40. As the receptacle system 100 is constructed rotationally symmetrically in certain regions, the radial direction 32 is based on this symmetry and runs in the radius about a longitudinal axis 35 of the receptacle system 100. The detail about top or bottom 33 relates to a mounting position of the receptacle system 100.

In addition to the lid device 20, a rod 40 is included in the receptacle system 100, wherein the rod 40 is securely yet detachably carried by a holding device 1. The holding device 1 is likewise securely yet detachably arranged centrally in a holder receptacle 27. To this end, the holder receptacle 27 is provided with a lid inner surface 28 running in the axial direction 31, which has a corresponding geometric shape, like a holder external surface 6 of the holding device 1.

The rod 40 has an elongated shape, wherein a small rod end 42 is connected by means of a cylindrical shaft 41 to a thick rod body 43. For example, the thick rod body 43 is provided with stones, a precious stone and/or a temperature sensor. In particular, the rod 40 is produced from a transparent material, for example from glass.

FIG. 2 shows the lid device 20 from FIG. 1 with a mounted rod 40 in a detailed view. The lid device can in this case be subdivided into a spout section 21 and a closure section 22, wherein the closure section 22 is at least partially introduced into the receptacle opening 51.

The closure section 22 can in turn be subdivided into an annular region 23 and a lid region 24. To ensure a defined seat of the lid device 20 in the receptacle opening 51, a receptacle for lid sealing means 30 is provided on the circumference of the annular region 23, in this example as a circumferential groove.

The spout section 21 is at least partially configured as a funnel which widens upwards in the radial direction 32. On one side in the circumferential direction, this funnel is configured to be larger than on the opposite side. At the same time, structural means 34 which promote pouring are provided on the enlarged side, in order to enable a reliable, drip-free and defined pouring.

The lid region 24 functions as an actual cover of the receptacle opening 51 and is connected via a connecting region 26 to the annular region 23, wherein the lid region 24 is arranged offset in the axial direction 31 compared to the annular region 23.

The connecting region 26, or else the lid region 24, has one or more spout openings 29, which produce a fluid connection between the interior of the receptacle body 52 and the spout section 21. In this manner, with mounted rod 40, liquid can be poured out of the receptacle 50 via the spout section 21 without lifting off the lid device 20. The connecting region 26, the lid region 24 and the annular region 23 can for example be connected to one another by means of welding.

It is shown in FIG. 2 that the spout opening 29 is overlapped by the lid region 24 in the axial direction 31. Thus, suspended particles from the ambient air cannot settle in the interior of the receptacle 50, as a direct falling path of such a suspended particle running in the vertical direction or in the axial direction 31 is blocked by the lid region 24.

The opening cross section of the spout opening 29 runs substantially in the vertical direction or in the axial direction 31. In particular, there is no line of sight passage present running in the vertical direction or in the axial direction 31 between the interior of the receptacle 50 and the surroundings.

A holder receptacle 27 with a cylindrical holder inner surface 8 is provided in the lid region 24. A shoulder 25 is formed at a transition between the holder inner surface 8 and the lid region 24, which shoulder is used as a stop for the holding device 1 in the axial direction 31.

With reference to the illustration of the holding device 1 in FIG. 2 and the different views in FIGS. 3*a* to *d*, the geometric shape and functionality of the holding device 1 shall be explained. The holding device 1 for the rod 40 is arranged centrally in the receptacle 27, wherein an external diameter of the holder external surface 6 corresponds to an internal diameter of the lid inner surface 27 such that a secure yet detachable connection is produced.

Furthermore, external sealing means 9 are provided on the holder external surface 6, which can produce a fluid-tight connection with the lid inner surfaces 28. To this end, the external sealing means 9 are constructed as an external sealing lip 15 protruding from the holder external surface 6.

The holding device 1 is formed at least to some extent by two cylinder portions 4, illustrated in the non-limiting embodiment of the cylinder halves 4 which together in turn form a hollow cylindrical device body 3 of the holding device 1. The cylinder halves 4 are connected to one another by means of a folding device 5 in a region of the circumference such that they can be pivoted relatively to one another about a pivot axis 2. In this manner, these cylinder halves 4 can, in the folded state—shown in FIG. 3*a*—together form the hollow cylindrical device body 3 of the holding device 1. In this state, the holding device 1 can be introduced from above into the holder receptacle 27 by displacement in the axial direction 31.

To this end, the holding device 1 has a shoulder with a shoulder surface 11, which interacts with the shoulder 25 and thus delimits an axial movement of the holding device 1 in the lid device 20 on one side.

Figure 3B:
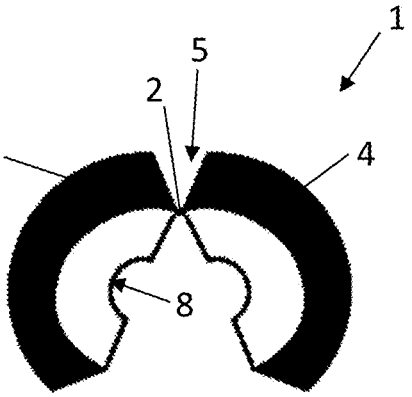

FIG. 3*b* describes the holding device 1 in an unfolded state. In this case, the shaft 41 of the rod 40 can be introduced into the rod receptacle 7, specifically independently of whether an external diameter of a rod end 42 is larger than an internal diameter of the rod receptacle 7.

In order to allow the cylinder halves 4 to be unfolded, the shoulder of the holding device has three triangle-like cutouts as viewed from above or from below 33.

Figure 3C:
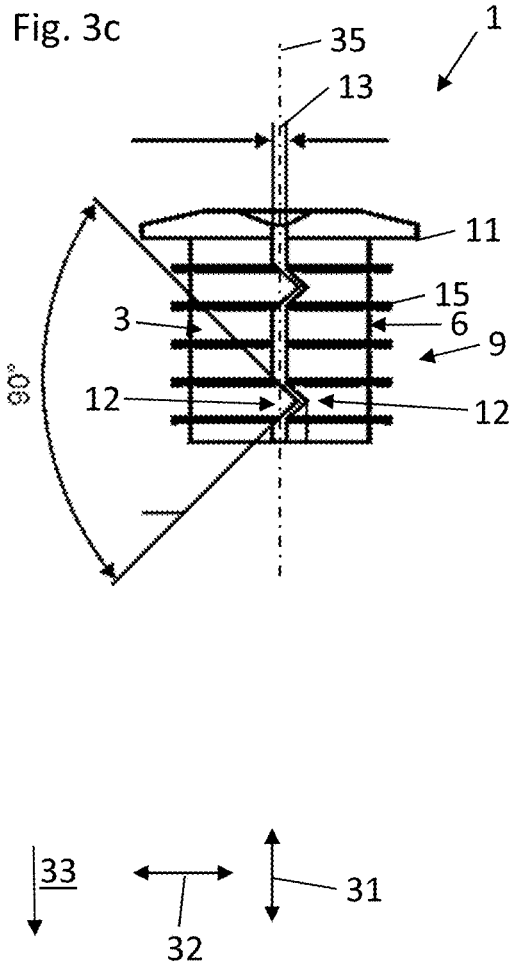
Figure 3D:
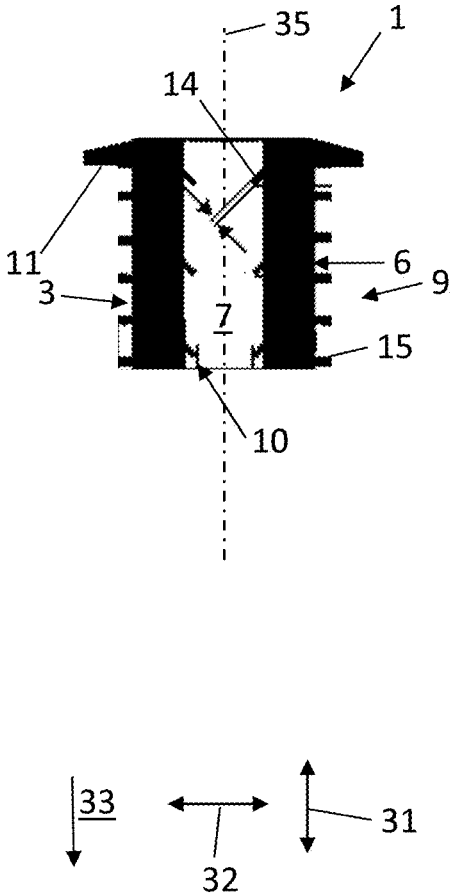

FIG. 3*c* shows the holding device 1 in the folded state in a side view. In this case, interlocking means 12 can be seen, which are configured as triangular projections on the left side and as triangular recesses on the right side. In the folded state, these interlocking elements, that is to say the left projection in FIG. 3*c*, engage into the right recess, as a result of which a positive-fitting interlocking of both cylinder halves 4 is created in the axial direction 31.

At the same time, the interlocking means 12 or the interlocking elements thereof are configured in such a manner that both cylinder halves 4 are also spaced from one another with a certain spacing 13 in the folded state.

The rod receptacle 7 is represented by a hollow, cylindrical volume inside the device body 3 of the holding device 1, wherein a holder inner surface 8 is provided with an inner sealing lip 14 projecting obliquely therefrom. The inner sealing lip 14 and the holder inner surface 8 are adapted, with regards to the size thereof, to the shaft 41 of the rod 40, so that the rod 40 can be carried securely yet detachably by the holding device 1.

How the receptacle system 100 can be assembled is explained with the aid of FIG. 4. First, the lid device must be pushed from above over the rod end 42 of the rod 40.

In a further step, the holding device 1 is placed around the shaft 41 of the rod 40 and folded together there.

Subsequently, the lid is displaced upwards, so that the holding device 1 is seated in the holder receptacle 27 and the shoulder 25 of the lid device 20 forms a limit in the axial direction 31 together with the shoulder surface 11 of the holding device 1.

In a final step, the unit of lid device 20 and rod 40 is inserted into the receptacle opening 51 of the receptacle 50.

Although specific embodiments have been illustrated and described here, it lies within the scope of the present invention to modify the embodiments shown in a suitable manner, without deviating from the protective scope of the present invention. The following claims constitute a first non-binding attempt to define the invention in general terms.

REFERENCE NUMBERS

1 Holding device
2 Pivot axis
3 Device body
4 Cylinder halves
5 Folding device
6 Holder external surface

7 Rod receptacle
8 Holder inner surface
9 External sealing means
10 Internal sealing means
11 Shoulder surface
12 Interlocking means
13 Spacing
14 Internal sealing lip
15 External sealing lip
20 Lid device
21 Spout section
22 Closure section
23 Annular region
24 Lid region
25 Shoulder
26 Connecting region
27 Holder receptacle
28 Lid internal surface
29 Spout opening
30 Lid sealing means
31 Axial direction
32 Radial direction
33 Bottom
34 Structural means which promote pouring
35 Longitudinal axis
40 Rod
41 Shaft
42 Rod end
43 Rod body
50 Receptacle
51 Receptacle opening
52 Receptacle body
100 Receptacle system

What is claimed:

1. A holding device (1) having a hollow, cylindrical device body (3), wherein the holding device (1) is configured to be arranged in a holder receptacle (27) having a cylindrical lid internal surface (28), extending in an axial direction (31), of a holder receptacle (27) of a lid device (20) for a receptacle (50), and wherein the holding device (1) is configured for holding a rod (40) with a cylindrical shaft (41), having two cylinder portions (4) and a folding device (5), wherein the cylinder portions (4) are connected to one another by the folding device (5), such that they can pivot about a pivot axis (2) in axial direction (31), so that the two cylinder portions (4) together form the hollow cylindrical device body (3) in a folded state, and thus the holding device (1) forms a holder external surface (6) extending in axial direction (31) and a rod receptacle (7) with a holder inner surface (8) extending in axial direction (31), wherein external sealing means (9) for interaction with the lid inner surface (28) of the holder receptacle (27) are provided on the holder external surface (6), and internal sealing means (10) for interaction with the shaft (41) of the rod (40) are provided on the holder inner surface (8), wherein, in the folded state of the holding device (1), the internal sealing means (10) are constructed as at least one internal sealing lip (14) arranged in a circular manner on the holder inner surface (8) and projecting inwards in the radial direction (32), and the external sealing means (9) are constructed as at least one external sealing lip (15) arranged in a circular manner on the holder external surface (6) and projecting outwards in the radial direction (32) with respect to the holder external surface (6).

2. The holding device (1) according to claim 1, wherein the cylinder portions (4) are two cylinder halves.

3. The holding device (1) according to claim 1, having a shoulder surface (11) running outwards substantially in a radial direction (32), for support on the lid device (20) in the axial direction (31).

4. The holding device (1) according to claim 1, wherein mutually corresponding interlocking means (12) are provided in the cylinder portions (4), which engage with one another in the folded state of the holding device (1) and act in a positive-fitting manner at least in the axial direction (31).

5. The holding device (1) according to claim 4, wherein the interlocking means (12) are arranged on an opposite side of the folding device (5) with respect to the circumference of the cylinder portions (4).

6. The holding device (1) according to claim 4, wherein the interlocking means (12) are arranged in the cylinder portions (4) in such a manner that both cylinder portions (4) are always spaced with a spacing (13) of 1 mm to 2.5 mm from one another in the folded state.

7. The holding device (1) according to claim 6, wherein the spacing (13) is 1.5 mm to 2 mm.

8. The holding device (1) according to claim 6, wherein the spacing (13) is exactly 2 mm.

9. The holding device (1) according to claim 1, wherein the at least one internal sealing lip projects downward (33).

10. The holding device (1) according to the claim 1, wherein the at least one external sealing lip projects vertically outwards in the radial direction (32).

11. A lid device (20) for a receptacle (50) having a cylindrical receptacle opening (51), having a holding device (1) having a hollow, cylindrical device body (3), wherein the holding device (1) is configured to be arranged in a holder receptacle (27) having a cylindrical lid internal surface (28), extending in an axial direction (31), of a holder receptacle (27) of a lid device (20) for a receptacle (50), and wherein the holding device (1) is configured for holding a rod (40) with a cylindrical shaft (41), having two cylinder portions (4) and a folding device (5), wherein the cylinder portions (4) are connected to one another by the folding device (5), such that they can pivot about a pivot axis (2) in axial direction (31), so that the two cylinder portions (4) together form the hollow cylindrical device body (3) in a folded state, and thus the holding device (1) forms a holder external surface (6) extending in axial direction (31) and a rod receptacle (7) with a holder inner surface (8) extending in axial direction (31), wherein external sealing means (9) for interaction with the lid inner surface (28) of the holder receptacle (27) are provided on the holder external surface (6), and internal sealing means (10) for interaction with the shaft (41) of the rod (40) are provided on the holder inner surface (8), a closure section (22) with at least one spout opening (29), with a holder receptacle (27) with a cylindrical lid internal surface (28) extending in the axial direction (31) for accommodating the holding device (1), and a spout section (21) adjoining the closure section (22) in an axial direction (31), wherein the holding device (1) is accommodated at least partially by the holder receptacle (27), and wherein the holder external surface (6) and the lid internal surface (28) of the holder receptacle (27) have mutually corresponding cylinder-like shapes and external sealing means (9) are provided and configured in such a manner that the holding device (1) can be arranged inside the lid internal surface (28) of the holder receptacle (27) in a detachable manner.

12. The lid device (20) according to claim 11, wherein the closure section (22) has an annular region (23) running at least partially in axial direction (31) and a lid region (24) running substantially in radial direction (32) thereto with a shoulder (25), wherein the holder receptacle (27) is arranged in the lid region (24), and wherein the shoulder (25) forms a stop for the holding device (1) acting in axial direction (31) on one side.

13. The lid device (20) according to claim 12, wherein lid sealing means (30) are provided in the radial direction (32) externally on the annular region (23) for interacting with the receptacle opening (51).

14. The lid device (20) according to claim 11, wherein the spout section (22) is connected to the annular region (23).

15. The lid device (20) according to claim 14, wherein the spout section (22) and the annular region (23) are produced in one piece.

16. The lid device (20) according to claim 15, wherein the spout section (22) and the annular region (23) are produced from a metal sheet by means of deep drawing.

17. A receptacle system (100), having a receptacle (50) with a carafe-like receptacle body (52) and a cylindrical receptacle opening (51), a lid device (20) for a receptacle (50) having a cylindrical receptacle opening (51), having a holding device (1) having a hollow, cylindrical device body (3), wherein the holding device (1) is configured to be arranged in a holder receptacle (27) having a cylindrical lid internal surface (28), extending in an axial direction (31), of a holder receptacle (27) of a lid device (20) for a receptacle (50), and wherein the holding device (1) is configured for holding a rod (40) with a cylindrical shaft (41), having two cylinder portions (4) and a folding device (5), wherein the cylinder portions (4) are connected to one another by the folding device (5), such that they can pivot about a pivot axis (2) in axial direction (31), so that the two cylinder portions (4) together form the hollow cylindrical device body (3) in a folded state, and thus the holding device (1) forms a holder external surface (6) extending in axial direction (31) and a rod receptacle (7) with a holder inner surface (8) extending in axial direction (31), wherein external sealing means (9) for interaction with the lid inner surface (28) of the holder receptacle (27) are provided on the holder external surface (6), and internal sealing means (10) for interaction with the shaft (41) of the rod (40) are provided on the holder inner surface (8), a closure section (22) with at least one spout opening (29), with a holder receptacle (27) with a cylindrical lid internal surface (28) extending in the axial direction (31) for accommodating the holding device (1), and a spout section (21) adjoining the closure section (22) in an axial direction (31), wherein the holding device (1) is accommodated at least partially by the holder receptacle (27), and wherein the holder external surface (6) and the lid internal surface (28) of the holder receptacle (27) have mutually corresponding cylinder-like shapes and external sealing means (9) are provided and configured in such a manner that the holding device (1) can be arranged inside the lid internal surface (28) of the holder receptacle (27) in a detachable manner, and a rod (40) with a cylindrical shaft (41), wherein the lid device (20) is arranged in the receptacle opening (51).

* * * * *